United States Patent [19]

De Baun

[11] 4,144,651

[45] Mar. 20, 1979

[54] MATERIAL MARKER

[76] Inventor: Mary De Baun, 182A E. Shore Dr., Massapequa, N.Y. 11758

[21] Appl. No.: 848,309

[22] Filed: Nov. 3, 1977

[51] Int. Cl.[2] ..... G01B 5/14

[52] U.S. Cl. ..... 33/189; 33/42

[58] Field of Search ..... 33/18, 42, 189, 190, 33/191, 11, 1 K, 1 B

[56] References Cited

U.S. PATENT DOCUMENTS

| | | | |
|---|---|---|---|
| 737,102 | 8/1903 | Holt | 33/42 |
| 1,732,017 | 10/1929 | Jenkins | 33/42 |
| 2,408,595 | 10/1946 | Beard | 33/189 |
| 2,448,627 | 9/1948 | Schaffner | 33/42 |
| 2,975,520 | 3/1961 | Ericson et al. | 33/189 |
| 3,429,050 | 2/1969 | McCarty | 33/189 |

FOREIGN PATENT DOCUMENTS

| | | | |
|---|---|---|---|
| 211782 | 1/1957 | Australia | 33/11 |

*Primary Examiner*—Richard E. Aegerter
*Assistant Examiner*—John W. Shepperd
*Attorney, Agent, or Firm*—Charles F. Gunderson

[57] ABSTRACT

A device for marking opposite sides of a double-layer of materials for clothing or the like having a pair of tongs with an upper arm positioned between a transparent or translucent pattern and the upper layer of the material, and a lower arm positioned between the lower layer of the material and a work surface. A handle end of the tongs positions the opposing open ends of the tongs under the portion of the pattern being transposed onto the material. The top of the opposing open end of the upper arm of the tongs has an outer dot or point sharply contrasting with the surface of the outer end, and an inner marking substance or chalk secured precisely under the contrasting dot. The opposing open end of the lower arm also has an inner marking substance or chalk, and the upper and lower inner marking chalks oppose each other so that when the arms of the tongs are pressed together they meet on the opposing sides of the upper and lower layers of material to mark opposing points corresponding to a point on the pattern.

3 Claims, 6 Drawing Figures

MATERIAL MARKER

BACKGROUND OF THE INVENTION

The art of making patterns for use in home dressmaking and the like is well established, and innumerable patterns are available. These are normally laid out on a very thin sheet of paper in the most expeditious manner to make the most of the cloth for a given garment. Only one side may be shown since almost all garments are made of mirror-image pattern cuts for the right and left hand sides of the garment. To save time it is often desirable to position the two pieces of cloth, opposing each other on the work surface and to mark them, or cut them simultaneously.

The pattern can, of course, be cut to make it easier to mark on the cloth, or to cut through the two opposing layers simultaneously. However, this breaks apart the pattern, and has other disadvantages. There are other methods of marking one side, such as perforations in the pattern along the critical lines through which a chalk impression can be marked. However, both of these techniques favor only one of the pieces of cloth, and, even though the opposing layers of cloth may be securely pinned together, it is not always possible or effective to try to cut both pieces of cloth together, since they tend to creep under the scissors and the two sides will not be the same.

DESCRIPTION OF THE PRIOR ART

There are a few devices, such as that of the "Dressmakers Marking Pliers" of Holt, U.S. Pat. No. 737,102 patented Aug. 25, 1903, that have opposing chalks to mark out both sides of a particular section of a garment in the same operation. However, it is not seen how these pliers could fit, nor is there any suggestion or teaching in Holt as to how these pliers could be fit, under a pattern. Nor is it seen how they could follow a fine, intricate series of lines since there is no provision for alignment with a pattern. They are too bulky to do this effectively, even if there were, since the slightest change in angle would alter the pattern. The pliers of Holt can only be presumed to be effective, with a certain amount of skill, for transposing a pattern from one side to another. In any case, they were not effective enough to fill the need for a marking device, and after over seventy years, do not appear to be in use today.

Another device that has opposing marking capabilities is seen in the dress pattern marker of Schaffner, U.S. Pat. No. 2,448,627, issued Sept. 7, 1948. Here again we see bulky jaws, and a relatively complicated mechanism for rotating the opposing chalks to make a mark. However, the shape of the device and the teachings here are most clear that this is for "a pattern having piercings or opening therein through which the goods may be marked in some manner —." It is clearly taught that the upper crayon must be on top of the pattern and be aligned with an opening in the pattern and that the contact of the upper crayon is made through the opening in the pattern. This device would also appear to be too bulky to fit under a pattern — and there is no teaching as to how it could be used in such a manner, nor how it could be adapted to be used in such a manner.

SUMMARY OF THE INVENTION

A device for marking opposing sides of two layers of material from a given pattern has opposing marking elements on opposing ends of a tong-like marker. At least one of the ends has a sharply-contrasting dot or point directly above the center of the corresponding chalk. This point or dot is aligned under a given point along a line of a pattern that is to be marked on the cloth. The tong-like device is then compressed to bring together the opposing markers on the opposing sides of the opposing layers of material to mark both sides of the material simultaneously. The dot may be directed along the lines of the pattern, under the transparent or translucent pattern material, and marks may be made along the entire length of the pattern as frequently and as precisely as may be desired.

The essence of this device is in its flat, thin structure that permits the device to fit under the pattern, without substantially raising the pattern from the material, or disturbing its orientation; and in the addition of a clear contrasting dot or point that can easily be seen under the pattern and can be aligned with the pattern quickly and accurately.

DESCRIPTION OF THE PREFERRED EMBODIMENT

Figure 1:
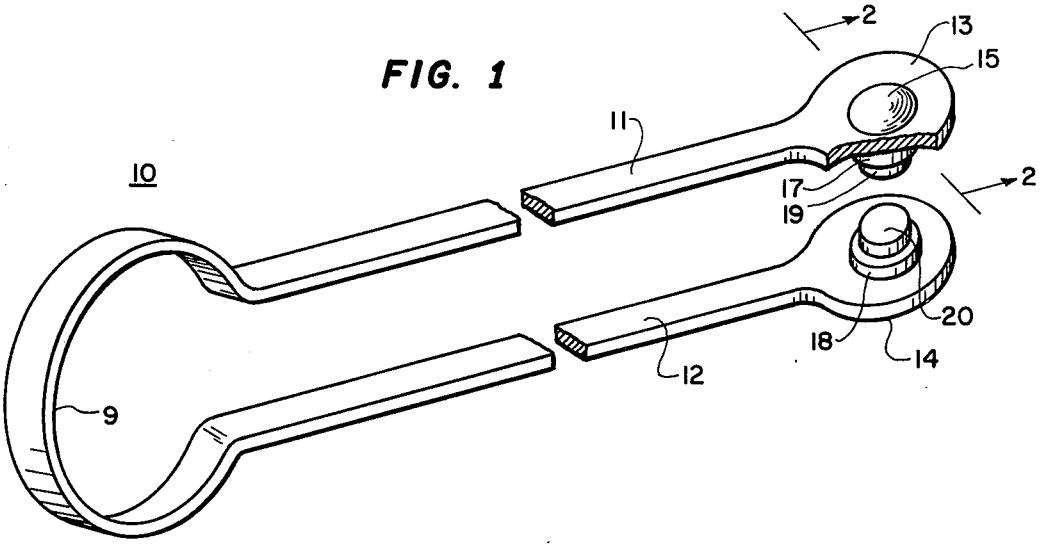
FIG. 1 shows an isometric view of the overall device.

Referring now more particularly to FIG. 1, the overall device is shown in an isometric view with the tong-like structure 10 having a handle end 9 joining an upper lever arm 11, with an upper marking end 13, and a lower lever arm 12 with a lower marking end 14.

The upper marking end 13 has a cut-away portion to more clearly show contrasting dot or point 15 aligned above a chalk holder 17 and a chalk 19. The lower marking end 14 has its corresponding chalk holder 18 and chalk 20.

Figure 2A:
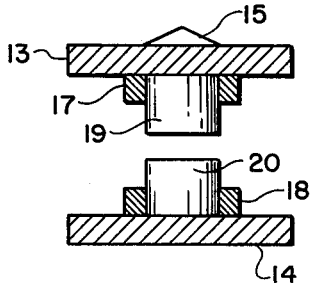
FIGS. 2A and 2B show cross sections of the opposing ends of the device.
Figure 2B:
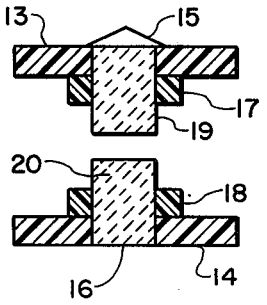

FIGS. 2A and 2B show cross sections of the marking ends 13 and 14. Both show the essential dot or point 15 on the upper side; the chalk holders 17 and 18; and the chalks 19 and 20. These figures also show that an alternate dot or point 16 may be included on the lower side.

Figure 3:
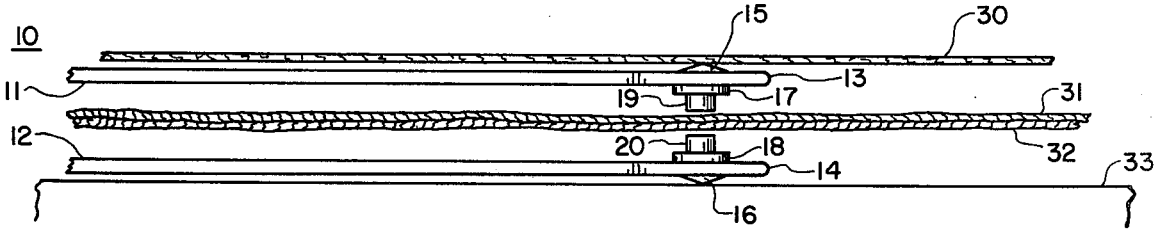
FIG. 3 shows a side view of the device in operation.

FIG. 3 shows the device 10 in operation with a transparent or translucent pattern 30 on top of the overall device. The upper lever arm 11 and its marking end assembly 13 are seen between the upper layer of material 31 and the pattern 30. The lower lever arm 12 and its marking end assembly 14 are seen between the lower layer of material 32 and the table top or work surface 33. The contrasting dot or point 15 is seen under the pattern, and the alternate dot or point 16 is seen next to the work surface.

Figure 4:
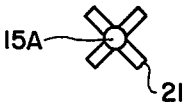
FIGS. 4 and 5 show variations in the marking dot.
Figure 5:
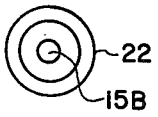

FIG. 4 shows lines 21 intersecting a dot 15A and FIG. 5 shows a concentric circle 22 surrounding a dot 15B.

In operation, the pattern 30 is laid out in the normal way, over the two layers of material 31 and 32, that are resting on the table top or work surface 33. When the pattern and material are in the optimum conjunction, they may be pinned or secured, in the normal way, at the ends or sides to prevent sliding or being displaced while the pattern is being transposed.

At this time the pattern transposing device 10 is slid into position with its upper lever arm 11 and marking assembly 13 between the pattern 30 and the upper layer of cloth or material 31, and its lower lever arm 12 and marking assembly 14 between the lower layer of material 32 and the work surface 33, as shown. The dot or point 15, that can be clearly seen through the pattern material, is moved to the first point to be marked. The lever arms are then depressed at the handle end, or the dot may be depressed, through the pattern, to force the marking chalks together, in opposition, to clearly mark both sides of the material simultaneously. If a stronger mark is desired, the handle end of the device may be moved slightly — preferably in the direction of the pattern line — or rotated about its marking ends as much as practical without disturbing the orientation of either the pattern or the material.

Aside from the novel size and shape of this device to fit under and precisely copy the lines of a given pattern without disturbing the relationship between the pattern and the cloth, the essential feature is the small dot or point that must contrast sharply with the color of the upper — or lower — marking end to be clearly seen under the translucent pattern.

In this regard, the lower lever arm and its marking end 14 may have a different color, and the dot 16 may have a different contrasting color, shape, or size than that of the upper lever arm marking end assembly and dot. The upper and lower arms may then, obviously, be reversed when the differing contrasts may be more clearly visible under different pattern colors or different circumstances.

The visibility of the dots on either the upper or lower marking ends may also be enhanced by accentuating circles or intersecting lines as seen in FIGS. 4 and 5. These would have the advantage of being more visible, through the pattern, to an untrained eye, and permitting the use of a smaller dot without it being hidden by the lines of the pattern being copied. The accentuating lines or circles may be of the same color as the dot, or of another color to provide even greater contrast.

In more opaque patterns, the contrasting dot may not stand out as clearly, but a pointed tip, as seen in the drawings, may be provided. This point will be noticeable as it moves under a thin pattern, and it may be felt through the pattern at any given point to be marked. This is convenient since the most practical way of using this device and marking the cloth would be to depress the marking ends of the device through the pattern to obtain the maximum pressure on the opposing chalks for the clearest possible marks.

The standard marking media for transposing patterns onto a cloth is usually a form of chalk. This is intended to be used here, although any other marking means, compatible with the material to be marked, may also be used. It will be obvious that the color of the chalk must be chosen to be clearly visible on the material, and the chalk must be soft enough to make a clearly visible mark on the material with a minimum of pressure or motion of the device.

The holders 17 and 18, will obviously be standard friction or compression rings or devices of any kind, well known in the art, to hold the chalks securely in a marking position, and permit the chalks to be adjusted in depth or interchanged in a well known manner. The depth of the chalks must be kept to a minimum to keep a minimum distance between the pattern and the cloth.

The lever arms may be of any suitable size and shape to provide reasonable rigidity and a precise register of the chalks in opposition. They must also be as flat as possible to provide the minimum spacing between the pattern and the upper layer of cloth. The lever arms need only be long enough to reach the inner-most point of a pattern from any convenient side of the pattern.

It is to be understood that I do not desire to be limited to the exact details of construction shown and described since obvious modifications will occur to a person skilled in the art.

What is claimed is:

1. A device for marking opposing sides of two layers of cloth positioned between a translucent pattern of a given color and a work surface comprising: a flat straight upper lever arm and a flat straight lower lever arm connected together at one end by a common handle; the other end of said upper lever arm having a first relatively-small dot of a sharply-contrasting color with respect to said given color of said translucent pattern, centrally located on the outside of said upper lever arm, and a first cloth-marking means, directly under said small dot, located on the inside; said first dot forming a point projecting slightly above the level of said outside of said other end of said upper lever arm; the other end of said lower lever arm having a second cloth-marking means, centrally located on the inside, aligned with and opposing said first cloth-marking means of said upper lever arm; said other end of said lower lever arm having a second relatively-small dot of a different, sharply-contrasting color with respect to said given color of said translucent pattern, centrally located on the outside of said other end of said lower lever arm and aligned with said second cloth-marking means, said second dot forming a point projecting slightly below the level of said outside of said other end of said lower lever arm; said upper lever arm being positioned between said pattern and the upper of said layers of cloth; and said lower lever arm being positioned between the lower of said layers of cloth and said work surface, whereby said first dot can be positioned under a given point of said pattern, and the drawing together of said upper and said lower lever arms will provide opposing marks simultaneously on said upper and said lower of said layers of cloth to correspond with said given point of said pattern.

2. A device for marking opposing sides of two layers of cloth as in claim 1 wherein said first dot is surrounded by at least one concentric circle of a contrasting color with respect to said first dot and the given color of said translucent pattern.

3. A device for marking opposing sides of two layers of cloth as in claim 1 wherein the colors of said outsides of said other ends of said upper and said lower lever arms are different, and the contrasting colors of said first and second dots are different from the colors of their corresponding arms to accommodate variations in the tints of various translucent patterns.

* * * * *